US006780051B2

(12) United States Patent
Otsu

(10) Patent No.: US 6,780,051 B2
(45) Date of Patent: Aug. 24, 2004

(54) COAXIAL CONNECTOR AND MANUFACTURE THEREOF

(75) Inventor: Akihiko Otsu, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/287,628

(22) Filed: Nov. 5, 2002

(65) Prior Publication Data

US 2003/0092289 A1 May 15, 2003

(30) Foreign Application Priority Data

Nov. 9, 2001 (JP) ..... 2001-344211

(51) Int. Cl.[7] ..... H01R 9/05

(52) U.S. Cl. ..... 439/578; 439/620

(58) Field of Search ..... 439/578, 620, 439/188, 941

(56) References Cited

U.S. PATENT DOCUMENTS 5,062,811 A * 11/1991 Hackman ..... 439/620
5,326,280 A * 7/1994 Briones et al. ..... 439/581
5,407,366 A * 4/1995 Briones et al. ..... 439/639
6,036,545 A * 3/2000 Caviness et al. ..... 439/620
6,309,250 B1 * 10/2001 Hyzin ..... 439/578

* cited by examiner

*Primary Examiner*—Tulsidas C. Patel
(74) *Attorney, Agent, or Firm*—Rader, Fishman & Grauer PLLC

(57) ABSTRACT

To provide a coaxial connector which inhibits radiation of an electromagnetic wave to the outside of the device and enables improvements in electromagnetic compatibility (EMC); a method of manufacturing the connector; and a method of inhibiting leakage of an electromagnetic wave using the coaxial connector. A connection section to be connected to a conductive panel is formed from a conductive material. A dielectric substance formed for ensuring insulation of an external conductor from a conductive panel is made thin. A dielectric substance (insulator) acting as a radiation rout of an electromagnetic waveform is sandwiched between two conductors.

12 Claims, 8 Drawing Sheets

COAXIAL CONNECTOR AND MANUFACTURE THEREOF

BACKGROUND OF THE INVENTION

1. Field of the Invention

The invention relates to a coaxial connector connected to a conductive panel, and more particularly, to a coaxial connector, a connecting part of which is to be connected to the conductive panel which is constituted of conductive material.

2. Related Art

A BNC connector is usually connected as a coaxial connector to be connected to a conductive panel.

In some BNC connectors, a signal ground of an external conductor is coupled directly to a ground frame of the conductive panel, to thereby ensure grounding. When a plurality of devices are interconnected by means of BNC connectors, such a grounding method enables formation of a ground loop by means of a potential difference among the devices. As a result, flow of an electric current arises among the devices.

In order to prevent formation of such a ground loop, there is described a capacitive-coupling connector, as disclosed in Japanese Patent No. 2578675.

In the capacitive-coupling connector, a capacitor is interposed between an external conductor and a conductive panel in order to connect them together. The capacitor enables electric discharge of electricity from the external conductor to the conductive panel so that the capacitive-coupling between the potential of the external conductor and the potential of the conductive panel may be made.

In the case of a BNC connector having a capacitor incorporated therein, a connection section (screws) must be constituted of an insulator so as to prevent direct connection between the external conductor and the conductive panel.

However, plastic is used as an insulative material for a connection section. Since plastic is a kind of dielectric material, an electromagnetic wave developed in the devices may radiate to the outside of the devices through a plastic member.

In this regard, when a coaxial cable is connected to a terminal on a conductive panel, a connection section of the connector is formed such that an external conductor of the connector, a plastic member (a dielectric substance), and a conductive panel are connected, in this order. Here, a plastic member (i.e., a dielectric substance) portion also serves as a screw. For this reason, the thickness of the plastic member (dielectric substance) portion cannot be made extremely thin. In order to connect the external conductor and the conductive panel to the connector while ensuring mutual isolation, a certain degree of thickness is required.

However, as the thickness of the plastic member (dielectric substance) increases, the distance between shield walls constituted of the external conductor and a conductive panel becomes greater, thereby failing to effectively shield an electromagnetic wave. Hence, a screw section of a conventional BNC connector having a certain thickness inevitably fails to prevent electromagnetic waves developed in a device from radiating to the outside of the device through the plastic member.

A clock frequency used in a device, which is mainly responsible for developing electromagnetic waves, is increasing year by year. Since the electromagnetic wave with a higher frequency can more easily pass through a dielectric substance due to the properties thereof, a leakage of the electromagnetic waves may become more.

In particular, a device having a plurality of connection ports radiates an electromagnetic wave to the outside of the device more as the number of ports is increased.

SUMMARY OF THE INVENTION

It is an object according to the present invention to provide a coaxial connector which lowers radiation of the electromagnetic wave to the outside of the device and is improved in electromagnetic compatibility (EMC). It is also an object to provide a manufacture method of thereof and a preventing method of electromagnetic wave leakage by using the coaxial connector.

According to the present invention, there may be provided a connector which has a connection part to be connected to a conductive panel made of a conductive material and a thin dielectric member formed for ensuring insulation between an external conductor and the conductive panel wherein the connector has a structure that the thin dielectric member (insulator), which may be a path of an electromagnetic wave, is sandwiched between the conductor and the conductive panel.

More specifically, the invention provides the followings.

(1) A coaxial connector having an elongated internal conductor, a cylindrical external conductor being coaxial with the internal conductor, and an insulation main body for fixing the internal conductor and the external conductor in an electrically-insulating manner, wherein the insulation main body comprises a block part for fixing the internal conductor and the external conductor to a root part of the insulation main body with the internal conductor and the external conductor insulated from each other, and a cylindrical part for covering a portion of an outer periphery of the external conductor; and wherein the cylindrical part of the insulation main body has a conductive member for shielding an electromagnetic wave.

According to the present invention, there is further provided a coaxial connector including:

an elongated internal conductor, an external conductor, in which at least a portion of the internal conductor is inserted, and an insulation main body fixing the external conductor and covering at least a portion of the external conductor;

the coaxial connector comprising:

a coaxial cylindrical dielectric member at least a portion of which is inserted between the internal and the external conductors;

wherein the insulation main body comprises a block part and a cylindrical part with both parts connected to each other substantially along the axis of the coaxial connector;

the block part securing the internal conductor and the cylindrical dielectric member via the external conductor;

the cylindrical part wrapping around and/or holding a portion of an outer periphery of the external conductor and being wrapped around and/or held on the outer periphery thereof by a conductive member so that the cylindrical part has such overlapping portion wrapping and being wrapped around.

According to the present invention, a conductive member for shielding (or blocking) passage of an electromagnetic wave is provided on an outer periphery of a cylindrical part of an insulation main body of a coaxial connector. And a connection portion of the coaxial connector has a structure having an external conductor, the cylindrical part (a dielectric member), and a conductive member connected in the order so that an electromagnetic wave (noise) that passes the dielectric member may be attenuated between shielding walls of the external conductor and the conductive member, thereby minimizing the leakage of a developed electromagnetic wave from the coaxial connector.

The conductive member, which may include a conductive flange as an example, also works as a screw which serves as a mount portion to a conductive panel. Since the screw is made of a conductive material such as metal, the strength of the screw is increased if compared to a plastic screw.

If it is needed to insulate the external conductor from the conductive panel, the cylindrical part should be made of insulating material because the cylindrical part is not insulated from the external conductor and because it serves as a mount portion to the conductive panel. However, the plastic screw may not have enough strength as a mounting portion. The thickness can be increased for the strength, but a thicker plastic mounting portion may cause leakage of an electromagnetic wave through the portion. Hence, a thinner plastic portion is more preferable.

According to the present invention, a cylindrical part (a dielectric member) is made thin and a mount part to a conductive panel is made of a conductive material. Although the cylindrical part (i.e., the insulation portion) is made thin, it secures the strength of the mount part by means of its mechanical property. The overlapping portion, for example, may include a portion having the cylindrical part (a dielectric member) wrapped around with an outmost cylindrical conductive flange and wrapping around the cylindrical external conductor. The cylindrical external conductor further wraps around the cylindrical dielectric member, which wraps around the coaxial internal conductor.

Here, with the coaxial connector, the internal conductor is generally an elongated thin conductor, which is assembled into the insulation main body so as to penetrate through the insulation main body. The external conductor, on the other hand, may be assembled into the insulation main body without penetrating the main body and stopped at a root part end face of the main body. The external conductor may be a long cylindrical conductor which encloses (or surrounds) the internal conductor and extends along the common axis of the internal conductor of the coaxial connector.

(2) The coaxial connector as recited in (1), comprising an electrical contact for constituting an electric circuit within the insulation main body;

wherein the electrical contact is inserted into an opening on a first side face of the block part such that it is connected to the external conductor and to the conductive member via a capacitor.

According to the present invention, as described above, the coaxial connector as recited in (1) comprises an electrical contact connected to the external conductor and the conductive member via a capacitor, wherein the electrical contact is inserted in an opening on a first side face of the block part.

According to the present invention, an electrical contact, which is conductive, may be inserted through an opening on a first side face of the block part and installed in a hollow space, which is connected to the opening, inside of the block part of the insulation main body. The electrical contact also may be connected to the conductive member and to the external conductor through a capacitor. The electrical contact contributes to an electric circuit within the insulation main body which may connect the coaxial connector to the ground so as to help the coaxial cable extending from the connector perform its functions.

With the conventional coaxial cable, an electrical contact for grounding the coaxial cable is provided in the vicinity of an mounting part of the connector and it is necessary for the electrical contact to contact with the conductive panel. The electrical contact is disposed inside the insulation main body, thereby enabling direct connection between the conductive panel and the conductive member, which is connected to the electrical contact via the capacitor. Hence, the reliability of the connection between the conductive panel and the conductive member can be enhanced.

If the electrical contact is provided outside the connector and has a spring finger which can elastically deform to engage with an electric element inserted into the connector, the connection between the electric element and the spring finger by pressing each other may have higher possibility to cause inadequate contact. According to the present invention, the electrical contact is installed within the connector and an unstable electrical contact between the electric element and the electrical contact can be prevented. Therefore, any disconnection in the electric elements may be prevented.

(3) The coaxial connector as recited in (1) or (2), wherein the opening is disposed on the first side face and/or a second side face that opposes to the first side face; and wherein the other two faces have no opening.

According to the present invention, the coaxial connector as recited in (1) or (2) is characterized in that the block part has four side faces and that the opening is disposed only on a first side face and/or a second side face opposing to the first side face.

(4) There is provided a coaxial connector having an insulation main body for fixing an internal conductor and an external conductor, which are electrically insulated from each other, wherein the insulation main body has a block part for fixing the internal conductor and the external conductor at a root part; and a cylindrical section for covering a portion of an outer periphery of the external conductor;

wherein openings are disposed on a first side face and a second side face of the main body, which are opposing to each other; and wherein no openings are disposed on other two faces opposing to each other.

According to the present invention, the insulation main body comprises four side faces surrounding the insulation main body, wherein two openings formed on the side faces are disposed in two mutually-opposing side faces of the block part of the insulation main body of the coaxial connector; and wherein no openings are disposed in the other two mutually-opposing side faces.

An opening making process and labor may be saved if compared to the conventional coaxial connector having openings in all side faces.

Since openings are disposed in only two mutually-opposing side faces of the block part, many coaxial connectors may be formed at the same time with molding dies which are aligned to the direction perpendicularly penetrating the other two side faces.

(5) There is also provided a device having a conductive panel to which the coaxial connector set forth in any one from (1) to (4) is attached.

According to the present invention, the coaxial connector set forth in any one of (1) to (4) may be attached to the conductive panel, thereby enabling communication between devices connected by way of the connector cable. So, advantages set forth in items (1) through (4) may be achieved. By way of example, such device may an include two-way and one-way communication devices.

(6) There is provided a method of manufacturing a coaxial connector having an insulation main body for fixing an internal conductor and an external conductor, which are electrically insulated from each other, wherein the insulation main body has a block part for fixing the internal conductor and the external conductor at a root part of the insulation main body, and a cylindrical part for covering a portion of an outer periphery of the external conductor, wherein the block part has an opening for inserting a predetermined part, the method comprising:

placing the insulation main body with the face of the opening in a predetermined direction, and inserting the part through the opening.

According to the present invention, there is provided a method for making a coaxial connector having an insulation main body for fixing an internal conductor and an external conductor, which are electrically insulated from each other, wherein the insulation main body has a block part for fixing the internal conductor and the external conductor at a root part of the insulation main body, and a cylindrical part for covering a portion of an outer periphery of the external conductor, wherein the block part has openings for inserting predetermined parts on both or either of two opposing faces of the block part, the method comprising:

placing the insulation main body with the both or either of two opposing faces oriented as they face devices that provide the parts, and providing the parts by pushing the parts.

According to the present invention, with the method for manufacturing the coaxial connector as recited in (3) or (4), a predetermined component (an electrical contact, a capacitor, and the like) may be placed in an opening leading toward the inside of the block part without turning the insulation main body.

In other words, in a method for making the coaxial connector recited in (3) or (4), openings (windows open at a side face or faces of the block part) are disposed on two mutually-opposing side faces of the block part and not in the remaining two mutually-opposing side surfaces of the same. It is possible that predetermined necessary components (or parts) are put together through holes (crevices, or openings to inside) in the two mutually-opposing faces of the block part without changing the direction of the faces. As a matter of course, there is no necessity for a process of putting a component into the other two surfaces which have no openings or windows.

According to the present invention, the number of processes and steps associated with the manufacture of the connector for the coaxial cable can be reduced.

(7) There is provided a method of lowering leakage of an electromagnetic wave from a coaxial connector, the connector having an insulation main body having a block part for fixedly positioning an internal conductor and an external conductor while they are electrically insulated from each other, and a cylindrical part for covering a portion of an outer periphery of the external conductor; the internal conductor being formed of an elongated conductor, the external conductor being coaxial with the internal conductor and being formed of a cylindrical conductor, wherein a conductive member to be attached to a conductive panel is provided on the outer periphery of the cylindrical part.

According to the present invention, there is provided a method of lowering leakage of an electromagnetic wave, comprising:

fixing on a conductive panel an coaxial connector having an insulation main body including a block part for fixedly positioning an internal conductor and an external conductor while they are electrically insulated from each other, and a cylindrical part for covering a portion of an outer periphery of the external conductor; the internal conductor being formed of an elongated conductor, the external conductor being coaxial with the internal conductor and being formed of a cylindrical conductor, wherein a conductive member to be attached to the conductive panel is provided on the outer periphery of the cylindrical part;

connecting the conductive member to the conductive panel; and connecting a coaxial cable to the coaxial connector.

According to the present invention, a conductive material for shielding (or blocking) passage of an electromagnetic wave is provided on an outer periphery of a cylindrical part of the insulation main body. An electromagnetic wave (noise) is attenuated between the external conductor and the flange, thereby minimizing the dosage of an electromagnetic wave developing from the coaxial connector.

(8) The method for lowering leakage of an electromagnetic wave as recited in (7), wherein the cylindrical part of the insulation main body has even thinner.

According to the present invention, the cylindrical part of the insulation main body is made thinner so that the distance between the shield walls constituted of the external conductor and the conductive member becomes small. Hence, in most part between the shield walls, an electromagnetic wave travels uniformly and perpendicular to the walls, thereby enhancing the attenuation efficiency of the electromagnetic wave. Therefore, leakage of the electromagnetic wave from the coaxial connector can be suppressed further.

DETAILED DESCRIPTIONS OF THE PREFERRED EMBODIMENT

A coaxial connector according to a preferred embodiment of the invention will be described hereinbelow.

Figure 1:
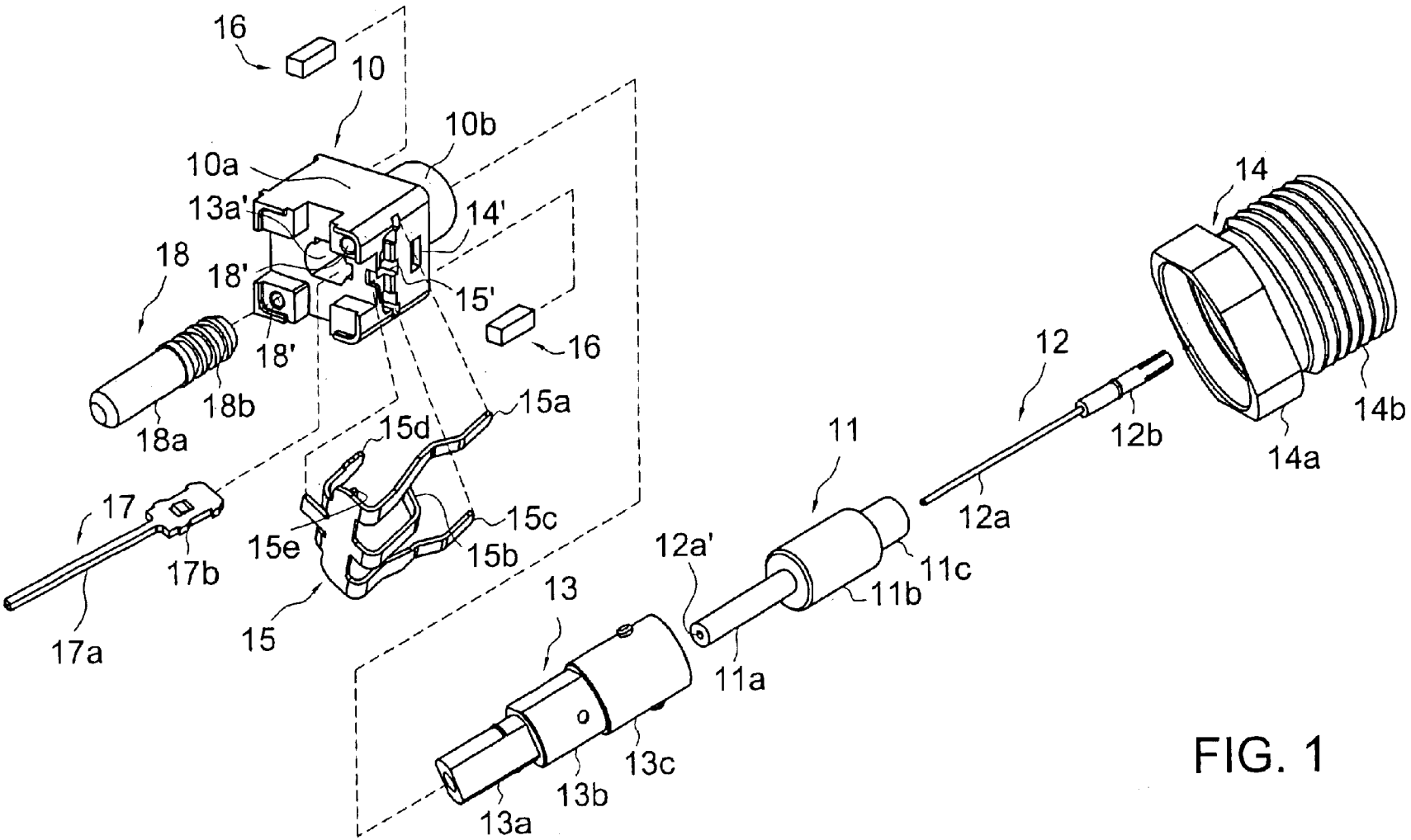
FIG. 1 is an exploded perspective view showing components constituting a coaxial connector according to a preferred embodiment.

FIG. 1 is an exploded perspective view of a coaxial connector according to a preferred embodiment of the present invention, showing components constituting the connector.

The coaxial connector of the preferred embodiment of the invention is mainly constituted of an insulation main body 10; a insulative internal conductor receiving dielectric member 11; an internal conductor 12; an external conductor 13; a conductive flange (conductive member) 14; a conductive electrical contact 15; a capacitor 16; a ground contact 17; and a pin 18. The elongated-needle-like internal conductor is inserted into the space around the center axis of the insulative internal conductor receiving dielectric member 11. The external conductor 13 is inserted into an insertion opening 13*a*' along the center axis in the center portion of the insulation main body 10. The ground contact 17 is disposed so as to be pressed between the outer periphery of the external conductor and an inner face of the insertion opening 13*a*'. Two pins 18 are fixed substantially in parallel to the center axis on diagonal squares across the center axis of the insulation main body 10.

The insulation main body 10 fixes the internal conductor 12 and the external conductor 13 in an electrically-insulated state with the insulative internal conductor receiving dielectric member 11 in between. The insulation main body 10 is constituted of a block part 10*a* for fastening the internal conductor 12 and the external conductor 13 at a root of the insulation main body 10; and a cylindrical part 10*b* for covering a portion of an outer periphery of the external conductor 13.

The block part 10*a* of the insulation main body 10 has a penetration hole 13*a*', which is penetrated by a flattened contact portion 13*a* of the external conductor 13 which receives in the center portion the thinner cylindrical portion 11*a* of the internal conductor receiving dielectric member 11 into which the internal conductor 12 is to be inserted; a hook opening 14' for hooking the flange 14 onto the insulation main body 10; an insertion hole 15' of the insulation main body 10 where the electrical contact 15 is inserted; and insertion holes 18' where the pins 18 of the insulation main body 10 are inserted.

The cylindrical part 10*b* of the insulation main body 10 is for covering a portion of the outer periphery of the external conductor 13. The cylindrical part 10*b* constitutes a cylinder having an outer diameter of about 6.0 mm and an inner diameter of about 5.5 mm. In the cylindrical part 10*b*, a dielectric portion has the thickness of about 0.25 mm. Hence, the cylindrical part is much thinner than a cylindrical part of the conventional coaxial connector.

The cylindrical part 10*b* and the block part 10*a* are disposed along the center line and made integrally. In another embodiment, they may be separate parts or one integrally formed part. The cylindrical part 10*b* and the block part 10*a* may overlap with each other.

The internal conductor receiving dielectric member 11 is penetrated by the internal conductor and insulates electrically the internal conductor 12 from the external conductor 13. The dielectric member 11 is made of dielectric material and is inserted into the inside of the external conductor 13 such that it is attached to the insulation main body 10.

Figure 2:
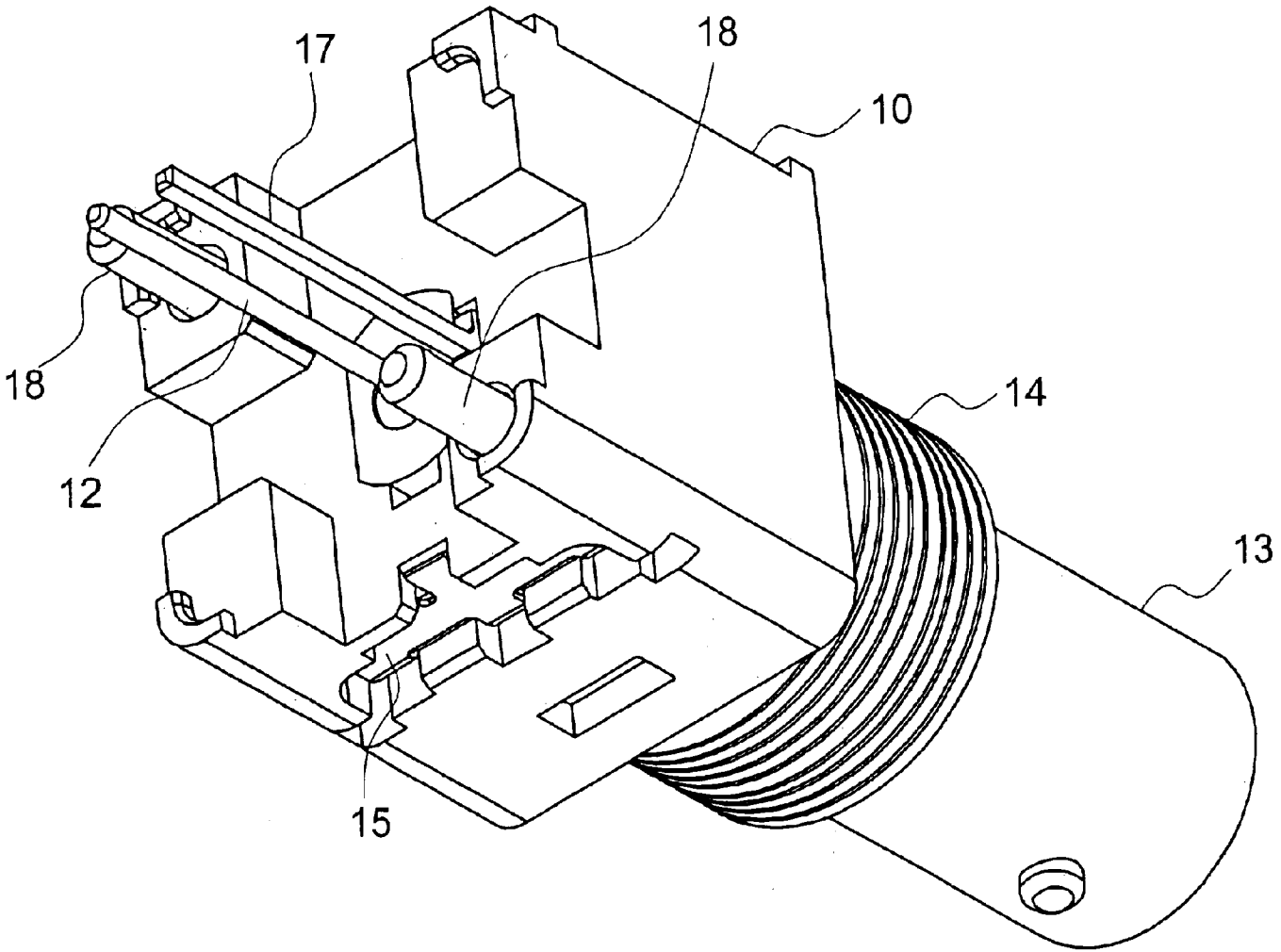
FIG. 2 is a perspective view showing the connector when components constituting the connector are assembled.

The internal conductor 12 is composed of a thin and elongated conductor and is constituted of a connection portion 12*a* to be connected to a device and a jack portion 12*b* for receiving a conductive wire of the coaxial cable. The connection portion 12*a* and the jack portion 12*b* are aligned to the common center axis. The internal conductor 12 is inserted into the dielectric member 11. A portion of the connection section 12*a* penetrates through a portion 12*a* of the dielectric member 11 and protrudes out of the dielectric member 11, and farther out of the insulation main body having the dielectric member 11 incorporated therein. The thus-projecting connection section 12*a* enables electrical connection with the device (FIG. 2).

The external conductor 13 is composed of a cylindrical conductor that is coaxial with the internal conductor 12. The external conductor 13 is constituted of a contact portion 13*a* for contacting with an external conductor ground contact 17; a contact portion 13*b* for contacting with a dielectric cylindrical part 10*b* of thin thickness; and a coaxial cable receiving part 13*c*. The entirety of the external conductor 13 has a cylindrical shell-shaped geometry, and the internal conductor receiving dielectric member 11 is inserted into the external conductor 13. When the internal conductor receiving dielectric member 11 is inserted into the external conductor 13, the contact part 13*a* coincides with the portion 11*a*, and the contact section 13*b* coincides with the portion 11*b*. The receiving part 13*c* projects from a portion 11*c*, whereby the external conductor 13 covers the internal conductor receiving dielectric member 11 having the internal conductor 12 inserted therein. As a result, the internal conductor 12 and the external conductor 13 are electrically insulated from each other.

The flange 14 is constituted of a incorporation portion 14*a* to be incorporated into the block part 10*a* of the insulation main body 10, and a panel attachment section 14*b* to which a conductive panel is to be attached. In relation to the flange 14, the incorporation portion 14*a* is latched into a hook opening 14' of the insulation main body while the panel attachment portion 14*b*, having a threaded portion, covers the cylindrical part 10*b* of the insulation main body.

There is constituted a coaxial connector having a structure in which the conductive panel attachment portion 14*b*, the dielectric cylindrical part 10*b*, and the conductive external conductor 13 are arranged in the order.

An electrical contact 15 comprises connection portions 15*a* and 15*c* to be connected to a capacitor 16; a connection portion 15*b* to be connected to the external conductor 13; and latch portions 15*d* and 15*e* to be latched onto the insulation main body 10. The electrical contact 15 is attached to the insulation main body by means of latching action of the latch portions 15*d* and 15*e* upon insertion into the insertion opening 15' of the insulation main body. Further, the electrical contact 15 enables electrical connection between the capacitor 16 and the external conductor 13 (particularly the contact poriton 13*a*).

The capacitor 16 is placed in a predetermined position on the insulation main body 10. One end of the capacitor 16 is electrically connected to the connection portion 15*a* or 15*c* of the electrical contact. The other end of the capacitor 16 is electrically connected to the incorporation portion 14*a*, thus constituting a portion of the electrical circuit. The capacitor 16 can provide a coaxial connector having a superior impedance characteristic, by means of incorporation of electrostatic capacitance corresponding to the frequency of a device to be used.

A ground contact 17 is constituted of a connection portion 17*a* of the device, and a contact portion 17*b* which is to be latched onto the insulation main body 10 and comes into contact with the external conductor 13. The connection portion 17*a* of the ground contact 17 is connected to a transmission signal line of the device and transmits a return signal sent from the external conductor. If the return signal has disappeared, the grounded electrical contact 15 is connected to the external conductor 13, and hence the external conductor is connected to the grounded via the capacitor.

Two kinds of grounds of different levels, that is, the flange 14 and the ground contact 17 connected different grounds, respectively, are made in the connector, and the capacitor 16 is provided between the two grounds, thereby electrically connecting the grounds together.

A pin 18 is constituted of a fixing portion 18*a* for securing to the insulation main body (or device), and an insertion portion 18*b* to be inserted into the insulation main body. The insert portion 18*b* is inserted into a pin insertion opening 18' the insulation main body, thereby attaching the pin 18 to the insulation main body.

FIG. 2 is a perspective view of a connector into which the components have been assembled.

A coaxial connector is completed by means of sequential assembly of components. A coaxial connector of the preferred embodiment can be constituted even in a sequence differing from the above-described sequence in which the components are assembled.

Figure 3:
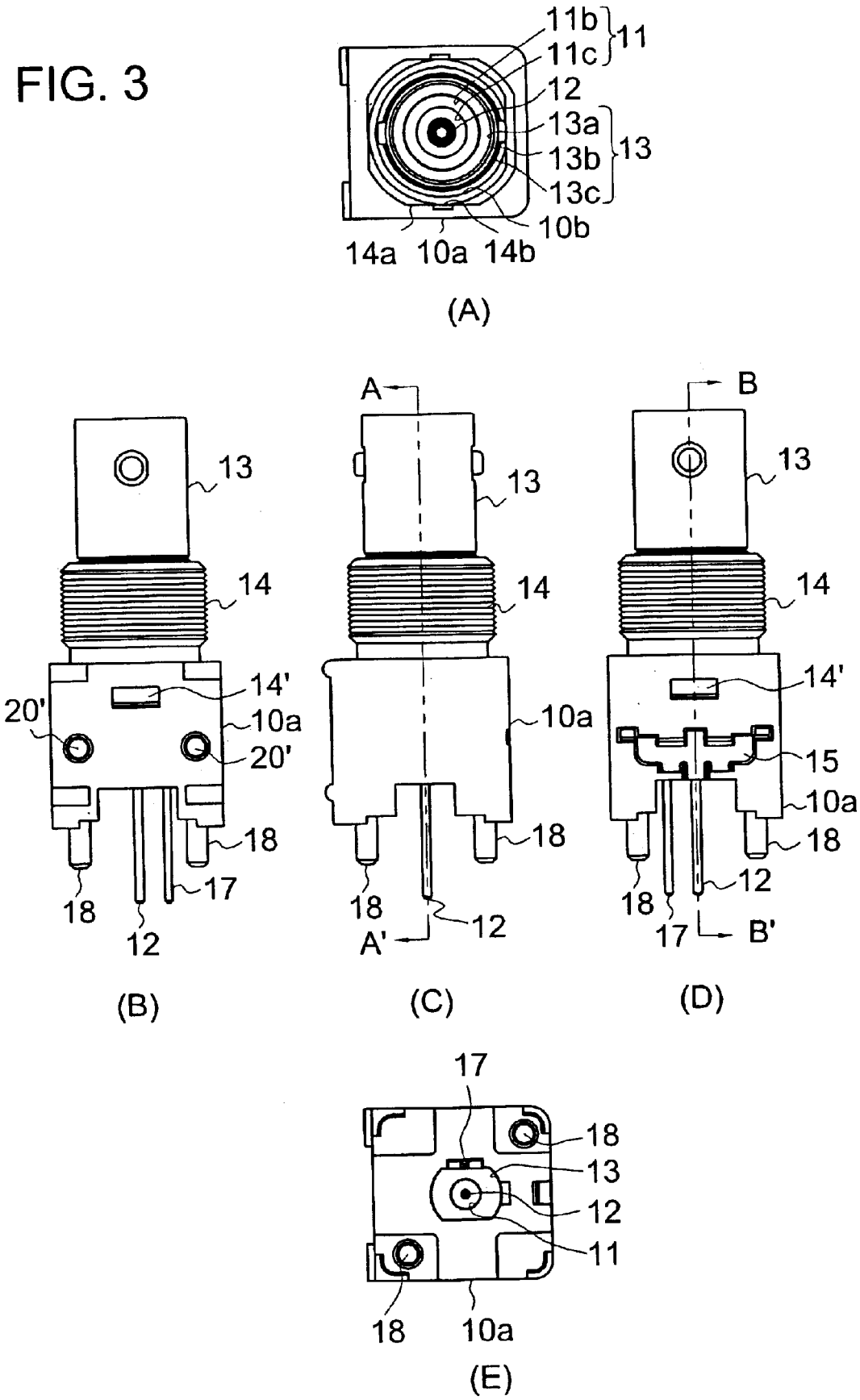
FIG. 3 shows a coaxial connector in various views ((A)–(E)) according to the preferred embodiment.

FIG. 3 shows views of a coaxial connector according to a preferred embodiment when viewed from respective faces. In FIG. 3(A), a top view is shown. In FIG. 3(B), a left-side view is shown. In FIG. 3(C), a front view (same as the rear view) is shown. In FIG. 3(D), a right-side view is shown. In FIG. 3(E) a bottom view is shown.

As shown in FIG. 3(B), a hook opening 14' of the insulation main body and openings 20' where a device is supposed to be inserted are formed in the block part 10*a* of the insulation main body 10. For example, a pin 18 will be inserted into the insertion hole 20' if the connector is arranged to be installed in a horizontal manner. As shown in FIG. 3D, the hook hole 14' of the insulation main body is formed in the block part 10*a* of the insulation main body 10.

As shown in FIG. 3C, no grooves (including windows, openings, insertion openings, recesses, etc.) extending to the inside of the block part are seen in the block part 10*a* of the insulation main body 10. When the insulation main body 10 is formed, no equipment such as an insertion bar is required to make such openings. Therefore, it is easy to pile up a plurality of forming dies in the direction form the front to the back so that the efficiency to form the insulation main body 10 of the coaxial connector may be increased.

As mentioned above, in the coaxial connector of the embodiment, an opening continuing inside of the block part is formed on each left and right side face of the block part. The two faces are opposing with each other. Further, no opening continuing inside of the block part is formed in the front or rear face of the block part, which are mutually-opposing with each other.

Figure 4:
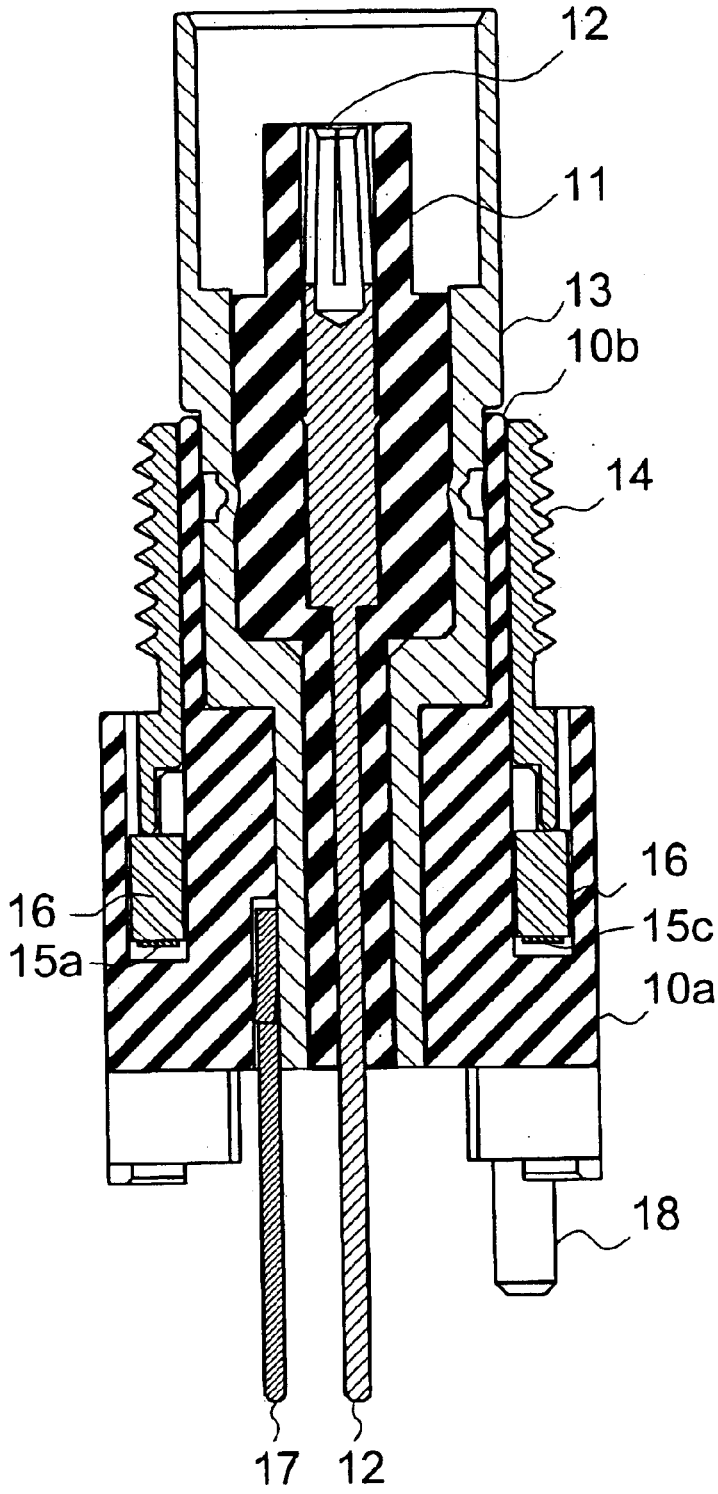
FIG. 4 is a cross-sectional view taken along line A–A' in FIG. 3(C).

FIG. 4 is a cross-sectional view taken along A–A' shown in FIG. 3(C).

As shown in FIG. 4, the internal conductor 12 is disposed in the center of the coaxial connector, and the internal conductor receiving dielectric member 11 is disposed so as to surround the internal conductor 12 and for the internal conductor 12 to penetrate through the end face shown in the lower portion of figure. Further, the external conductor 13 is disposed so as to surround the outer periphery of the internal conductor receiving dielectric member 11.

The insulation main body 10 is disposed around the lower outside of the external conductor 13. The ground contact 17 is pressed against the contact portion 13*a* of the external conductor 13 inside of the insertion opening 13*a'* of the insulation main body.

The cylindrical part 10*b* of the dielectric substrate coating a portion of the outer periphery of the external conductor 13 is thin, and a conductive flange 14 is disposed so as to surround the cylindrical part 10*b*.

As mentioned above, an electromagnetic wave which is radiated out of the external conductor 13 and permeates through the dielectric cylindrical part 10*b* is reflected by the conductive flange 14 and the reflected wave is further reflected by the external conductor 13. In this way, the electromagnetic wave is repeatedly reflected so that the electromagnetic wave is attenuated between shield walls of the external conductor 13 and the flange 14, thereby minimizing the dosage of the electromagnetic wave developing from the connector.

The capacitor 16 is fitted into the block section 10*a* of the insulation main body 10 and connected to the conductive flange 14. The portions 15*a* and 15*c* of the electric contact 15 are connected to the capacitor 16, thus constituting a portion of the electric circuit. The electric contact 15 has the portion 15*b* connected to the external conductor 13 (see FIG. 6).

Figure 5:
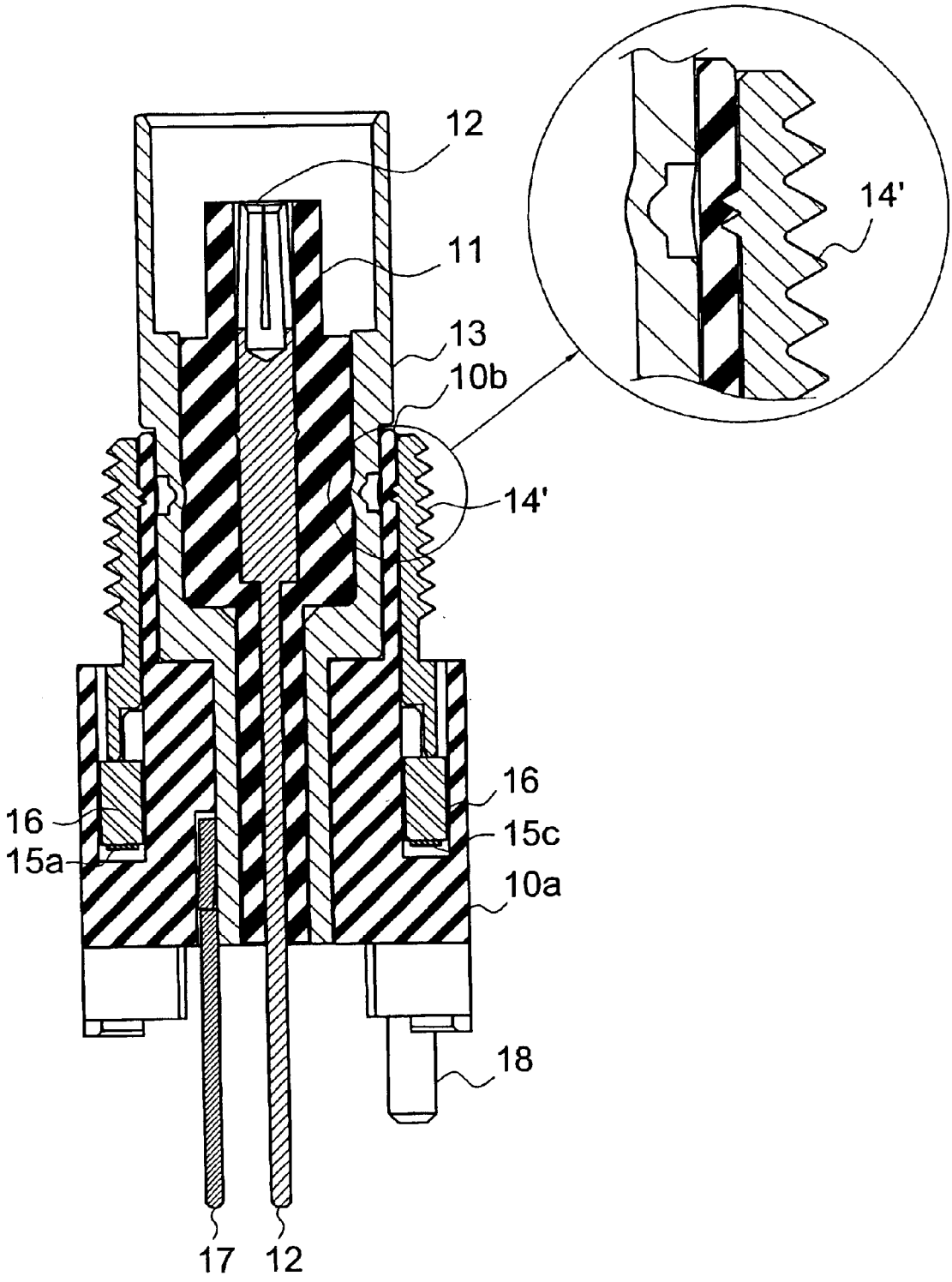
FIG. 5 is a cross-sectional view of a coaxial connector having a conductive flange modified in the shape. The view is taken along an equivalent line to the line A–A' shown in FIG. 3(C).

FIG. 5 is a cross-sectional view of a coaxial connector taken along the equivalent line to line A–A' shown in FIG. 3(C) according to another embodiment. The conductive flange 14 shown in FIG. 4 is modified in the shape.

As shown in FIG. 4, the general shape of the flange has only a helical groove formed in the outer peripheral surface of the flange 14. The flange 14 is inserted into an opening of the conductive panel. The flange 14 is electrically connected to the panel through fastening by use of a conductive washer and a conductive nut. As shown in FIG. 5, a helical groove is formed in the outer peripheral surface of the flange 14', and two protrusions are formed on an internal peripheral surface of the flange 14'. With such structure it may be more effective to attenuate an electromagnetic wave.

The internal peripheral surface of the flange may be formed into a shape having a helical groove formed in the internal peripheral surface of the flange as well as having the protrusions on the internal peripheral surface. In this case, the flange can be secured to the cylindrical part 10*b* of the insulation main body 10 utilizing the helical grooves.

Figure 6:
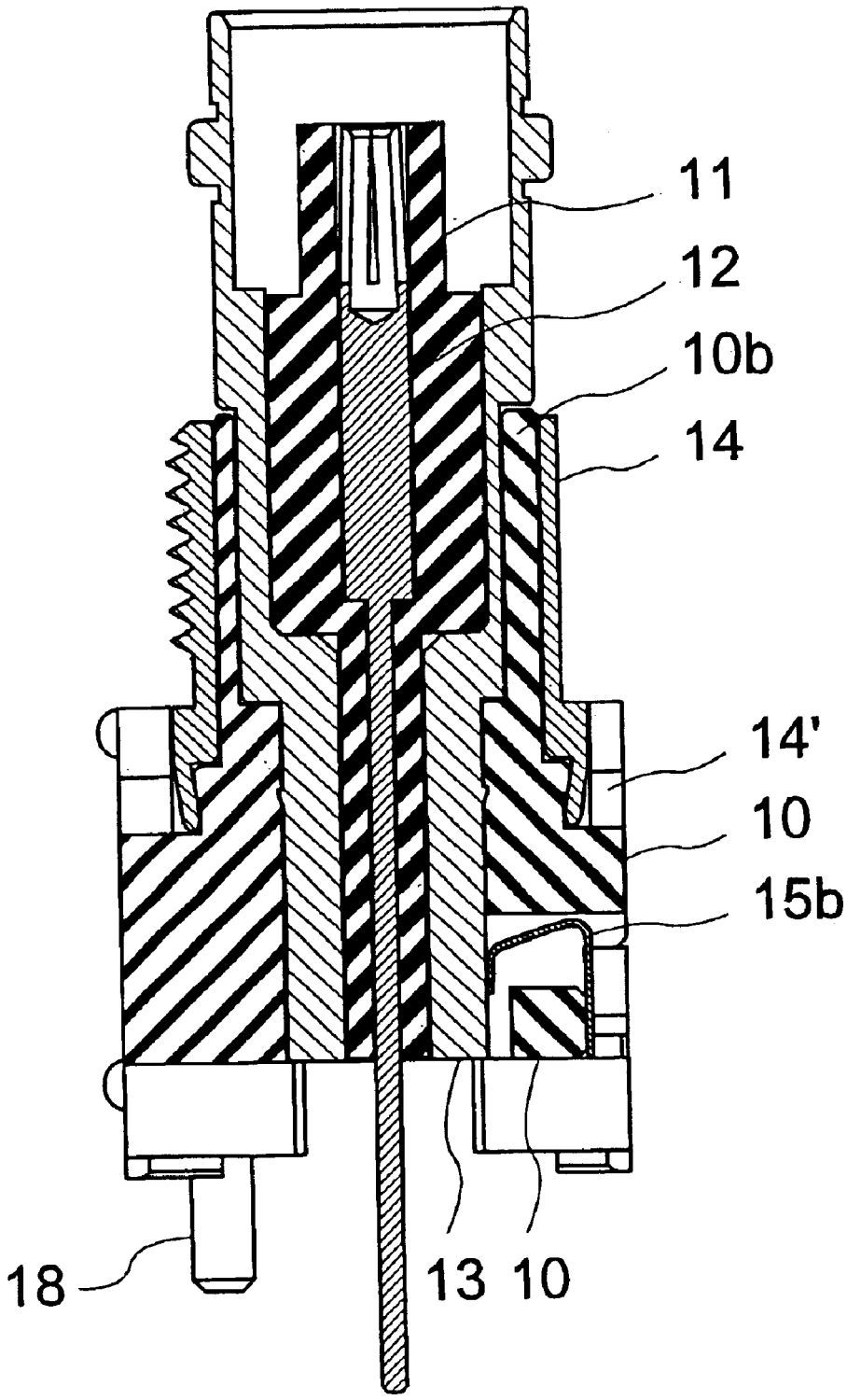
FIG. 6 is a cross-sectional view taken along line B–B' shown in FIG. 3(D).

FIG. 6 is a cross-sectional view taken along line B–B' shown in FIG. 3(D).

The basic structure of the coaxial connector shown in FIG. 6 is the same as described by reference to FIGS. 4 and 5. As is evident from the drawing, one end 15*b* of the electrical contact is in contact with and electrically connected to an outer peripheral surface of the external conductor 13, and the external conductor 13 and the electrical contact 15 are electrically connected together.

Figure 7:
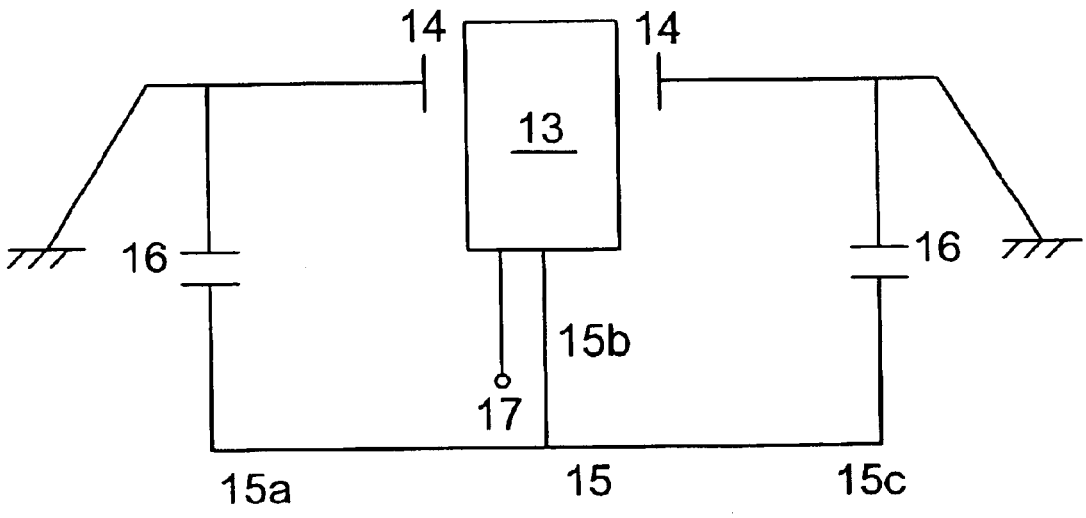
FIG. 7 is an electrical circuit diagram of a coaxial connector according to a preferred embodiment.

FIG. 7 is an electric circuit diagram of the coaxial connector according to a preferred embodiment of the present invention.

The coaxial connector of the embodiment has an electrical contact 15 for constituting an electrical circuit within the insulation main body 10. The electrical contact is electrically connected to the external conductor 13 which is connected to the ground contact 17. The electrical contact 15 is also connected to the flange 14, which is grounded.

The portion 15*a* of the electrical contact 15 is connected to one capacitor 16, and the portion 15*c* of the electrical contact 15*c* is connected to the other capacitor 16. Further, the portion 15*b* is connected to the external conductor 13.

The external conductor 13 is connected to the ground contact 17.

The capacitors 16 are electrically connected to the flange 14. However, they may be brought into direct contact with each other or connected together by means of wire-bonding.

When the coaxial connector of the invention is attached to the conductive panel 20, the flange 14 electrically connected to the conductive panel 20 is also grounded, because the conductive panel 20 is grounded.

Figure 8:
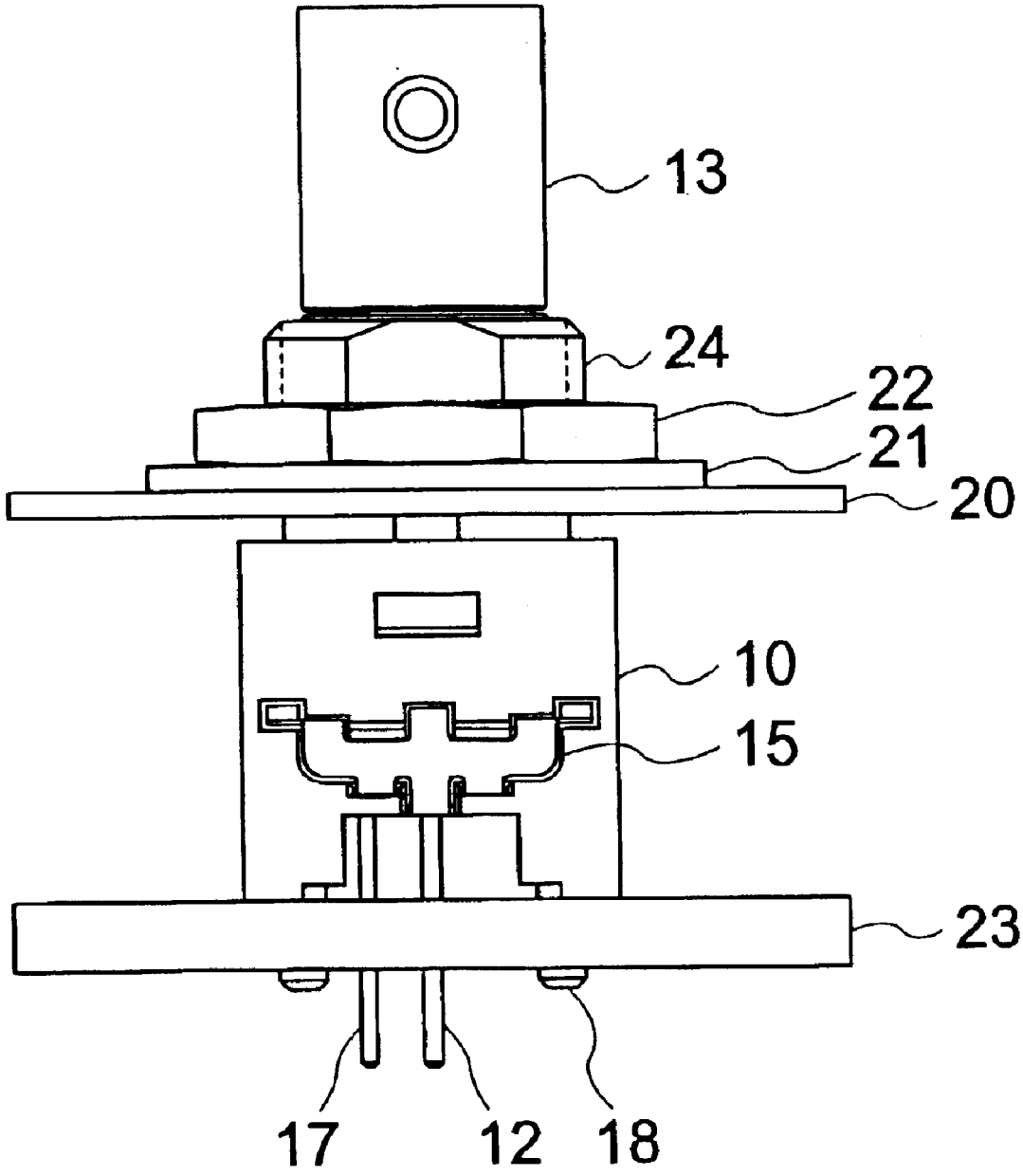
FIG. 8 is a side view showing the coaxial connector of the preferred embodiment according to the present invention.

FIG. 8 is a side view showing the coaxial connector of the embodiment according to the present invention. This is an example how the coaxial connector is used with the conductive panel 20, whereby the connector is used as a communication device.

The coaxial connector is fastened to a substrate (device) 23 by means of pins 18. Further, the flange 14 of the coaxial connector is inserted in an opening of the conductive panel 20 and fastened by means of a nut 22 by way of a washer 21. A locknut 24 secures fixation of the nut 22. Hence, the coaxial connector and the housing panel 20 are fixed together, thereby bringing the flange 14 into electrical contact with the panel 20.

EXAMPLE

An electric field intensity profile of the coaxial connector of the embodiment was measured in comparison to the conventional connector.

The measurement was conducted with a cubic having each edge length of 50 cm. The coaxial connector was mounted on the top face of the cubic, inside of which an electromagnetic wave of 1 GHz is generated.

With the conventional connector, the range of the electromagnetic wave of high intensity was around the connector. With the connector of the embodiment, the range of the electromagnetic wave of high intensity was much smaller than that with the conventional connector.

Therefore, use of the coaxial connector according to the present invention effectively lowers radiation of the electromagnetic wave to the outside of the device, thereby contributing to the improvement in electromagnetic compatibility (EMC) and radiation emission.

As described above, the invention adopts a structure in which a connection portion formed between the connector and the panel is sandwiched between the dielectric substance and the conductor. The electromagnetic wave penetrating through the dielectric substance is attenuated between shield walls of the external conductor and the flange. Hence, the dosage of an electromagnetic wave to the outside of the device can be minimized.

Unlike the conventional BNC connector, the electrical contact does not protrude form the connection part located between the dielectric substrate and the panel. The flange is electrically contacted with the panel and the high reliability of contact is ensured even when the electrical contact is subjected to repeated attachment and detachment.

What is claimed is:

1. A coaxial connector including:

an elongated internal conductor, an external conductor, in which at least a portion of the internal conductor is inserted, and an insulation main body fixing the external conductor and covering at least a portion of the external conductor;

the coaxial connector comprising:

a coaxial cylindrical dielectric member at least a portion of which is inserted between the internal and the external conductors;

wherein the insulation main body comprises a block part and a cylindrical part with both parts connected to each other substantially along the axis of the coaxial connector;

wherein the block part secures the internal conductor and the cylindrical dielectric member via the external conductor;

wherein the cylindrical part surrounds a portion of an outer periphery of the external conductor; and wherein a conductive member surrounds an outer periphery of the cylindrical part and has a threaded outer periphery.

2. A device comprising a conductive panel to which the coaxial connector as claimed in claim 1 is attached.

3. The coaxial connector as claimed in claim 1 characterized in that the block part has four side faces and that openings are disposed only on a first side face and a second side face opposing to the first side face.

4. A coaxial connector including:

an elongated internal conductor, an external conductor, in which at least a portion of the internal conductor is inserted, and an insulation main body fixing the external conductor and covering at least a portion of the external conductor;

the coaxial connector comprising:

a coaxial cylindrical dielectric member at least a portion of which is inserted between the internal and the external conductors; and an electrical contact connected to the external conductor, wherein the insulation main body comprises a block part and a cylindrical part with both parts connected to each other substantially along the axis of the coaxial connector;

wherein the block part secures the internal conductor and the cylindrical dielectric member via the external conductor;

wherein the cylindrical part surrounds a portion of an outer periphery of the external conductor;

wherein a conductive member surrounds an outer periphery of the cylindrical part;

wherein the electrical contact is connected to the conductive member via a capacitor, and wherein the electrical contact is inserted in an opening on a first side face of the block part.

5. The coaxial connector as claimed in claim 4 characterized in that the block part has four side faces and that the opening is disposed only on the first side face.

6. A device comprising a conductive panel to which the coaxial connector as claimed in claim 5 attached.

7. A device comprising a conductive panel to which the coaxial connector as claimed in claim 4 attached.

8. The coaxial connector as claimed in claim 4 characterized in that the block part has four side faces and that openings are disposed only on a first side face and a second side face opposing to the first side face.

9. The coaxial connector as claimed in claim 1 characterized in that the block part has four side faces and that an opening is disposed only on a first side face.

10. A device comprising a conductive panel to which the coaxial connector as claimed in claim 4 is attached.

11. A coaxial connector having an insulation main body for fixing an internal conductor and an external conductor, which are electrically insulated from each other, wherein the insulation main body has a block part for fixing the internal conductor and the external conductor at a root part; and a cylindrical section for covering a portion of an outer periphery of the external conductor;

wherein a conductive member surrounds an outer periphery of the cylindrical section;

wherein openings are disposed on a first side face and a second side face of the main body, which are opposing to each other; and wherein no openings are disposed on other two faces opposing to each other.

12. A device comprising a conductive panel to which the coaxial connector as claimed in claim 11 is attached.

* * * * *